United States Patent [19]

Yoshitomi et al.

[11] Patent Number: 5,039,359

[45] Date of Patent: Aug. 13, 1991

[54] PROCEES FOR PRODUCING GRAIN-ORIENTED ELECTRICAL STEEL SHEET HAVING SUPERIOR MAGNETIC CHARACTERISTIC

[75] Inventors: Yasunari Yoshitomi; Satoshi Arai, both of Kitakyushu, Japan

[73] Assignee: Nippon Steel Corporation, Tokyo, Japan

[21] Appl. No.: 508,814

[22] Filed: Apr. 16, 1990

[30] Foreign Application Priority Data

Apr. 17, 1989 [JP] Japan ..... 1-96831

[51] Int. Cl.[5] ..... H01F 1/04

[52] U.S. Cl. ..... 148/111; 148/112

[58] Field of Search ..... 148/111, 112

[56] References Cited

U.S. PATENT DOCUMENTS 4,773,948 9/1988 Nakaoka et al. ..... 148/111
4,824,493 4/1989 Yoshitomi et al. ..... 148/111

FOREIGN PATENT DOCUMENTS 46-23820 7/1971 Japan .
54-13846 6/1979 Japan .
56-3892 1/1981 Japan .
58-25425 2/1983 Japan .
59-45730 11/1984 Japan .
63-210237 8/1988 Japan ..... 148/111
63-45444 9/1988 Japan .

*Primary Examiner*—John P. Sheehan
*Attorney, Agent, or Firm*—Cushman, Darby & Cushman

[57] ABSTRACT

A process for producing a grain-oriented electrical steel sheet having a superior magnetic characteristic, comprising the steps of: hot-rolling a silicon steel slab comprising 0.021 to 0.100 wt % C, 2.5 to 4.5 wt % Si, one or more elements for forming inhibitors, and the balance consisting of Fe and unavoidable impurities, to form a hot-rolled sheet; coiling the hot-rolled sheet at a coiling temperature lower than 700° C.; subsequently cold-rolling the hot-rolled sheet at a reduction of 80% or more, effected by a plurality of rolling passes, to a final product sheet thickness; holding the steel sheet at a temperature of from 50° to 500° C. for 1 minute or longer at least once at the stage between the rolling passes of the cold rolling; decarburization-annealing the cold-rolled sheet; and final-annealing the decarburization-annealed sheet.

7 Claims, 3 Drawing Sheets

PROCEES FOR PRODUCING GRAIN-ORIENTED ELECTRICAL STEEL SHEET HAVING SUPERIOR MAGNETIC CHARACTERISTIC

BACKGROUND OF THE INVENTION

1. Field of the Invention

The present invention relates to a process for producing a grain-oriented electrical steel sheet having a superior magnetic characteristic and used for an iron core of transformers.

2. Description of the Related Art

Grain-oriented electrical steel sheets are mainly used as an iron core material for transformers and other electrical equipment and must have superior magnetic characteristics, including magnetic exiting and watt-loss characteristics.

The exiting characteristic is usually represented by the value $B_8$, i.e., a magnetic flux density when a magnetic field of 800A/m is applied, and the watt-loss characteristic is usually represented by the value $W_{17/50}$, i.e., a watt-loss value per 1 kg of a magnetic material when magnetized to 1.7 Tesla (T) under a frequency of 50Hz.

The flux density is the strongest factor dominating the watt-loss, and usually, the higher the flux density the better the watt-loss characteristic, although a higher flux density is occasionally accompanied by a coarsening of the secondary-recrystallized grains and resultant degradation of the watt-loss characteristic. The magnetic domain control, however, ensures an improved watt-loss characteristic regardless of the size of the secondary-recrystallized grains.

The magnetic characteristics of a grain-oriented electrical steel sheet are obtained through a Goss-orientation having a {110} plane parallel to the sheet surface and a <001> axis in the rolling direction, which is established by a secondary recrystallization occurring during a final annealing step. To obtain a good magnetic characteristic, the axis <001>, i.e., an axis of easy magnetization, must be precisely aligned in the rolling direction. The orientation of secondary-recrystallized grains is greatly improved by a process in which MnS and AlN, etc., are used as inhibitors and a final cold rolling is carried out at a severe reduction rate. This also leads to a remarkable improvement of the watt-loss characteristic.

In the production of a grain-oriented electrical steel sheet, a hot-rolled steel sheet is usually annealed to obtain a uniform microstructure and effect a precipitation treatment, etc. For example, Japanese Examined Patent Publication (Kokoku) No. 46-23820 discloses a process using AlN as the major inhibitor, in which a treatment for AlN precipitation is effected during an annealing of a hot-rolled sheet, to control the inhibitor.

A grain-oriented electrical steel sheet is usually produced through a process including main process steps such as casting, hot rolling, annealing, cold rolling, decarburization annealing, and final annealing. Such a process consumes a large amount of energy and the production costs are higher than those of a process for producing common steels.

Recent studies of this energy consuming process have concluded that a simplification and omission of process steps are necessary, and to this end, Japanese Examined Patent Publication (Kokoku) No. 59-45730 proposed a process using AlN as the major inhibitor, in which the AlN precipitation is effected during a high temperature coiling after hot rolling as a substitute for a separate AlN precipitation treatment step. This process ensures a certain level of magnetic characteristics without a separate annealing step of hot-rolled sheet, but a 5- to 20-ton hot coil adopted in most cases has locally different heat histories in one coil, which make a nonuniform AlN precipitation unavoidable, with the result that the magnetic characteristic of a final product sheet varies from place to place in a hot coil, and thus the product yield is lowered.

Japanese Examined Patent Publication (Kokoku) No. 54-13846 discloses another process using AlN as an inhibitor, in which a grain-oriented electrical steel sheet having a high magnetic flux density is obtained through single cold rolling step using a severe reduction of from 81 to 95%, and reports that the magnetic characteristic is improved by a rapid cooling after the annealing of a hot-rolled sheet and an aging treatment performed during a cold rolling using such a severe reduction.

Further, Japanese Examined Patent Publication (Kokoku) No. 56-3892 discloses a process for producing a grain-oriented electrical steel sheet using two or more steps of cold rolling, in which a steel sheet is rapidly cooled after an intermediate annealing, prior to a final cold rolling, and subjected to an aging treatment during the final cold rolling to improve the magnetic characteristic, and Japanese Unexamined Patent Publication (Kokai) No. 58-25425 discloses a process for producing a grain-oriented electrical steel sheet using two steps of cold rolling including a final cold rolling carried out at a reduction of from 40 to 80%, in which an aging treatment is performed during the first and the second steps of cold rolling, to improve the magnetic characteristic.

These processes using an aging treatment, however, cannot ensure a stable production of a steel sheet having a superior magnetic characteristic, through a single step of rolling and without an annealing of a hot-rolled sheet.

SUMMARY OF THE INVENTION

The object of the present invention is to provide a process for producing a grain-oriented electrical steel sheet having a superior magnetic characteristic, through a single step of cold rolling and without an annealing of a hot-rolled sheet.

To achieve this object according to the present invention, there is provided a process for producing a grain-oriented electrical steel sheet having a superior magnetic characteristic, comprising the steps of:

hot-rolling a silicon steel slab comprising 0.021 to 0.100 wt % C, 2.5 to 4.5 wt % Si, one or more elements for forming inhibitors and the balance consisting of Fe and unavoidable impurities, to form a hot-rolled sheet;

coiling the hot-rolled sheet at a coiling temperature lower than 700° C.;

subsequently cold-rolling the hot-rolled sheet at a reduction of 80% or more, effected by a plurality of rolling passes, to a final product sheet thickness;

holding the steel sheet at a temperature of from 50° to 500° C. for 1 minute or longer at least once at the stage between the rolling passes of said cold rolling;

decarburization-annealing the cold-rolled sheet; and final-annealing the decarburization-annealed sheet.

DESCRIPTION OF THE PREFERRED EMBODIMENTS

A grain-oriented electrical steel sheet to which the present invention is applied is produced through the steps of: continuous-casting or ingot-casting a molten steel prepared by a conventional steelmaking process, subjecting the thus-obtained casting to a blooming or slabbing step in accordance with the need to form a slab, hot-rolling the slab to form a hot-rolled sheet, subsequently cold-rolling the hot-rolled sheet at a reduction of 80% or more, decarburization-annealing the cold-rolled sheet, and then final-annealing the decarburization-annealed sheet.

After studying the coiling performed after hot rolling and the cold rolling, from various points of view, the present inventors found that the combination of the coiling temperature and the cold rolling condition has a close relationship with the magnetic characteristic. This will be described in more detail, based on experimental results, as follows.

Figure 1:
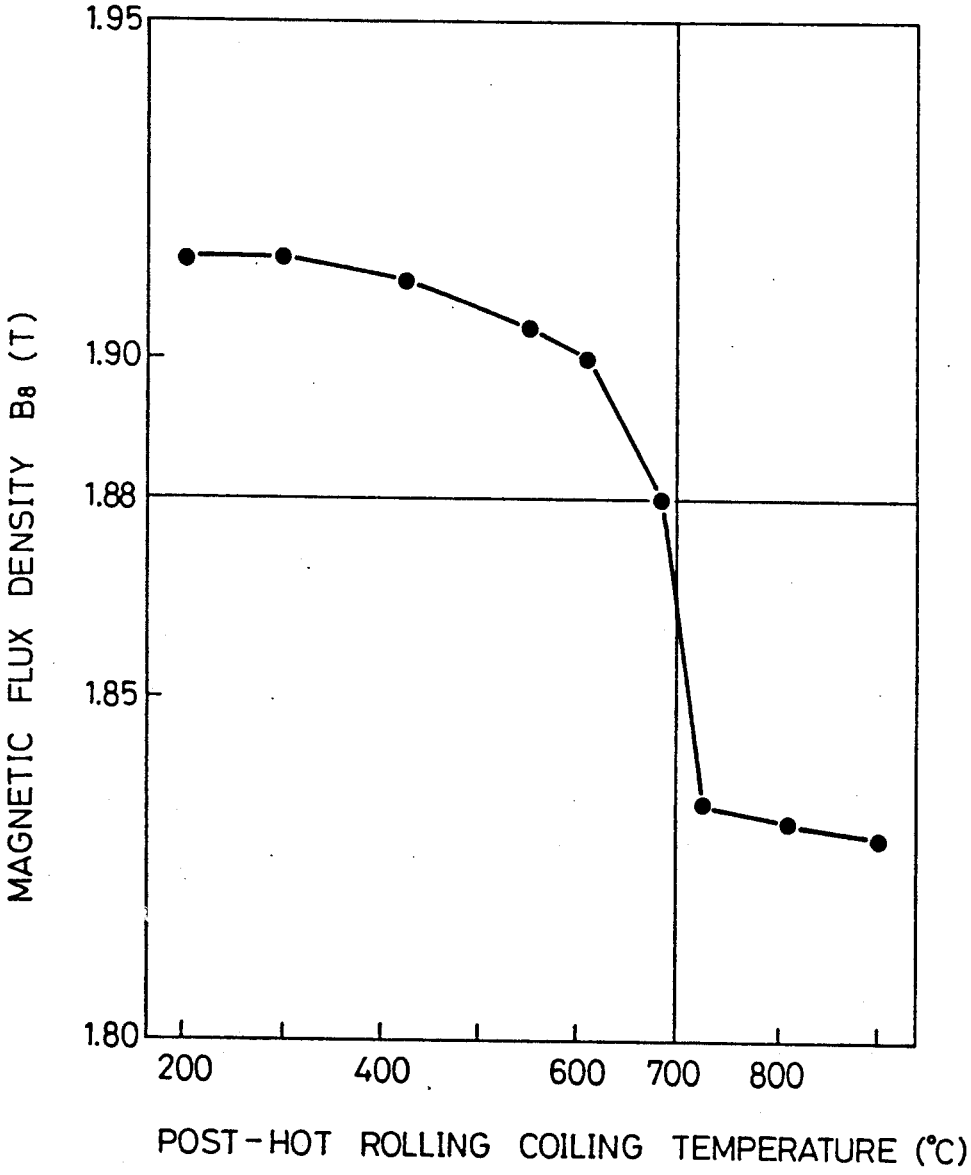
FIG. 1 shows a relationship between the temperature of coiling after hot rolling and the magnetic flux density.

FIG. 1 shows a relationship between the post-hot rolling coiling temperature (the coiling temperature after hot rolling) and the magnetic flux density of the product sheets produced in the following process sequence. Namely, 40 mm thick steel slabs comprising 0.054 wt % C, 3.28 wt % Si, 0.028 wt % acid-soluble Al, 0.0081 wt % N, 0.007 wt % S, 0.14 wt % Mn, and the balance Fe and unavoidable impurities, were heated to 1150° C. and hot-rolled through six rolling passes to form 2.3 mm thick hot-rolled sheets, which were then subjected to a coiling simulation in which the hot-rolled sheets were cooled to the shown different temperatures (coiling temperatures) of from 200° to 900° C. by various cooling methods using a combination of water and air cooling, and held at these coiling temperatures for 1 hour followed by a furnace cooling at a cooling rate of about 0.01° C./sec to obtain hot coils. Steel sheets from these hot coils, which were not annealed, were cold-rolled at a severe reduction of about 85% to form 0.335 mm thick cold-rolled sheets, during which cold-rolling an interpass aging at 200° C. for 5 minutes was carried out when the sheets had a thickness of 1.6 mm and when the sheets had a thickness of 0.8 mm. The cold-rolled sheets were then decarburization-annealed at 840° C. for 150 sec, applied with an annealing separator containing MgO as the major component, and final-annealed.

It can be seen from FIG. 1 that a high magnetic flux density $B_8$, of 1.88T or higher was obtained when the post-hot rolling coiling temperature was lower than 700° C.

Figure 2:
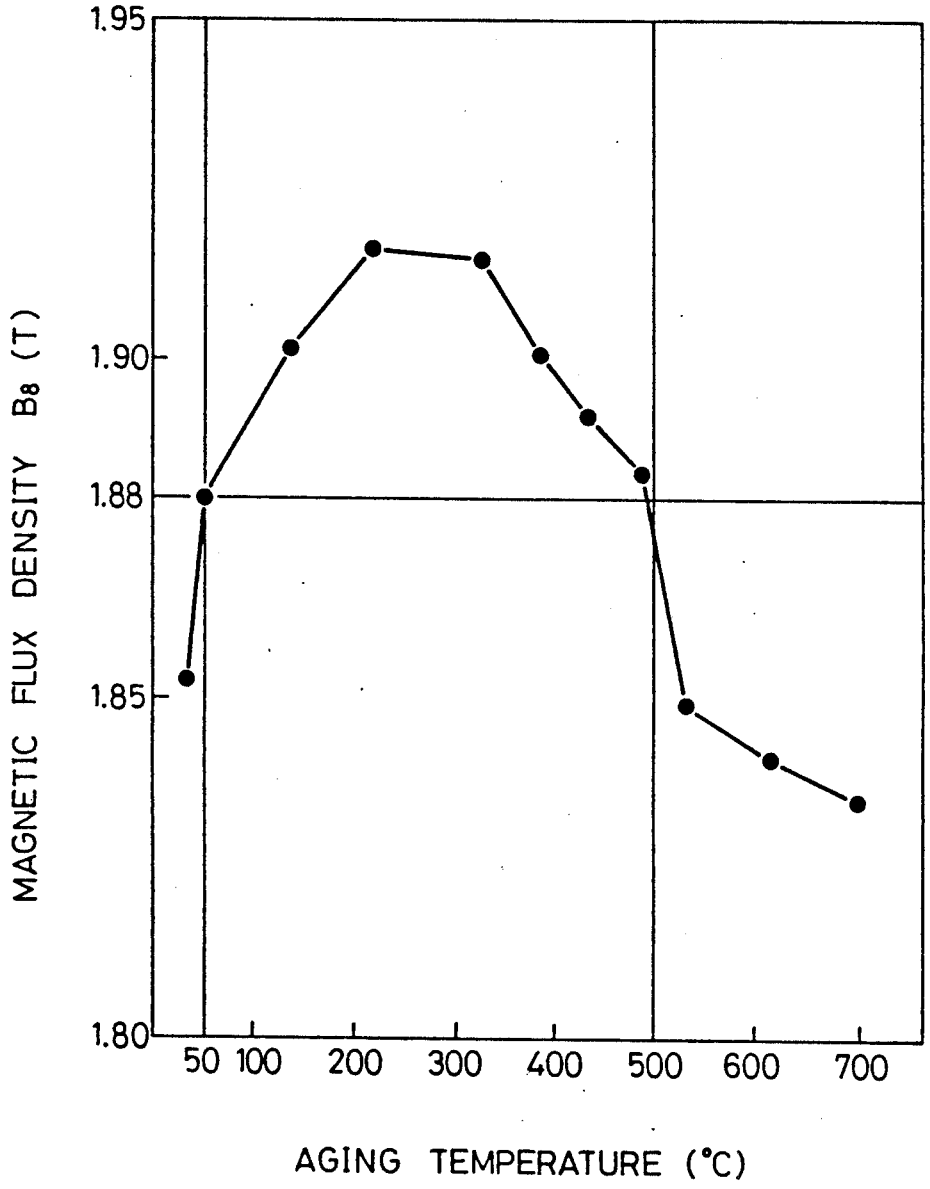
FIG. 2 shows a relationship between the temperature of aging effected between cold rolling passes and the magnetic flux density.

FIG. 2 shows a relationship between the interpass aging temperature and the magnetic flux density of the product sheets. In this case, sheets from the above-described coil having a coiling temperature of 550° C., which were not annealed, were cold-rolled at a severe reduction of about 85% to form 0.335 mm thick cold-rolled sheets, during which an inter-pass aging at the shown different temperatures for 5 minutes was performed twice. The cold-rolled sheets were decarburization-annealed, applied with an annealing separator containing MgO as the major component, and then final-annealed, in a known manner.

It can be seen from FIG. 2 that a high flux density, $B_8$, of 1.88T or higher was obtained when the interpass aging temperature was in the range of from 50° to 500° C.

Figure 3:
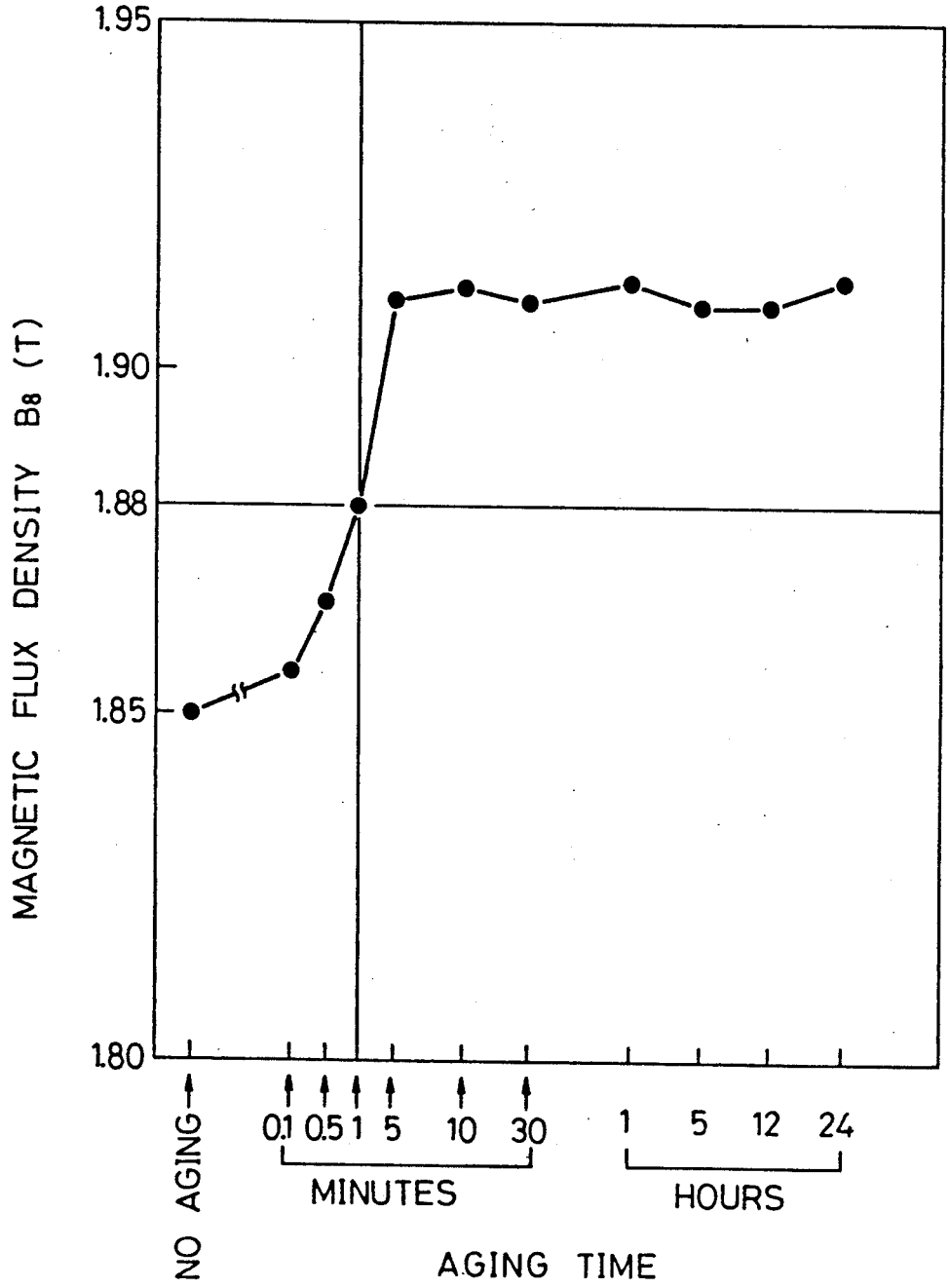
FIG. 3 shows a relationship between the holding time of aging effected between cold rolling passes and the magnetic flux density.

FIG. 3 shows a relationship between the duration of the interpass aging and the magnetic flux density of the product sheets. In this case, sheets from the above-described coil having a coiling temperature of 550° C., which were not annealed, were cold-rolled at a severe reduction of about 85% to form 0.335 thick cold-rolled sheets, during which an interpass aging at 200° C. for the shown different duration times was performed when the sheet had a thickness of 1.4 mm and a thickness of 0.7 mm.

It can be seen from FIG. 3 that a high flux density, $B_8$, of 1.88T or higher was obtained when the interpass aging was continued for 1 minute or longer.

It has not been fully elucidated why a certain combination of the post-hot rolling coiling temperature and the interpass aging condition during cold rolling improves the magnetic flux density of the product sheets, but the present inventors assume that the reason therefor is as follows.

Conventional improvements of the magnetic characteristics by an interpass aging during cold rolling are considered to be due to the fact that a deformation mechanism is affected by the solute C or N anchored to the dislocations or other defects formed during cold rolling, or affected by fine carbides or fine nitrides, interfering with the dislocation motion. Therefore, it is conventionally assumed that, prior to cold rolling, a heat treatment and a rapid cooling, for example, at a cooling rate of 5° C./sec or greater, must be carried out for forming solute C or N, or fine carbides or fine nitrides in the steel.

Usually, the cooling of the hot-rolled sheet coil is effected at an extremely low cooling rate, for example, at about 0.005° C./sec, because the coil is a 5- to 20-ton coil and such a massive coil is usually cooled by air cooling. Therefore, in the present invention in which a hot-rolled sheet is not annealed, it cannot be assumed that the conventionally required solute C or N, or fine carbides such as $\epsilon$-carbide and fine nitrides such as $Fe_{16}N_4$ smaller in size than hundreds of angstroms (Å) are present in a sufficient amount prior to cold rolling. On the other hand, during cooling after coiling, the $Fe_3C$ phase or the like precipitates on or at the vicinity of grain boundaries or around a nucleus precipitate within a grain, such as MnS and AlN, etc. When relatively small, for example, 1 μm or smaller, the $Fe_3C$ precipitate or the like can be partially dissociated and dissolved to form solute C and N during cold rolling. The present inventive effect cannot be obtained when the coiling of the hot-rolled sheet is carried out at a temperature of 700° C. or higher, presumably because the $Fe_3C$ precipitate or the like is easily coarsened during cooling after a high temperature coiling, and thus the dissociation and dissolution during the subsequent cold rolling is not enough to affect a deformation mechanism. Therefore, it is considered that the present inventive effect can be obtained because a relatively small $Fe_3C$ precipitate or the like formed during the cooling after coiling of a hot-rolled sheet are partially dissociated and dissolved during the cold rolling to form new solute C or N, which are anchored during an interpass aging to the dislocations or other defects formed during a cold rolling pass, and thereby affect a deformation mechanism. This facilitates the formation of a deformation band during cold rolling, increases the amount of grains having a {110} <001>-orientation during recrystallization after cold rolling, and improves the magnetic flux density.

The specified limitations according to the present invention will be described below.

The steel slab used in the present invention comprises 0.021 to 0.100 wt % C, 2.5 to 4.5 wt % Si, one or more inhibitor forming elements, and the balance consisting of Fe and unavoidable impurities.

The C content must be 0.021 wt % or more because, when the C content is less than this value, the secondary recrystallization becomes unstable, and even if secondary recrystallization is effected, a flux density, $B_8$, of 1.88T or higher is difficult to obtain. The C content must not exceed 0.100 wt %, to prevent an incomplete decarburization.

The Si content must not exceed 4.5 wt % because a Si content exceeding this value makes the cold rolling of a steel sheet difficult. The Si content must not be less than 2.5 wt % because, when the Si content is less than this value, it is difficult to obtain a good magnetic characteristic.

Inhibitor-forming elements according to the present invention include Al, N, Mn, S, Se, Sb, B, Cu, Bi, Nb, Cr, Sn, Ti, and other elements usually used for forming inhibitors, and may be adopted in accordance with need.

The slab heating temperature is not specifically limited but is preferably 1300° C. or lower, from the viewpoint of production costs.

A heated slab usually having a thickness of from 100 to 400 mm is subsequently hot-rolled to form a hot-rolled sheet.

The hot rolling step consists of a rough rolling stage and a finish rolling stage; both stages including a plurality of rolling passes. The rough rolling is not specifically limited and is carried out in a usual manner. The finish rolling is usually carried out by a high speed, continuous rolling of, for example, 4 to 10 rolling passes, so that the reduction per pass is higher in earlier passes and is lower in later passes, to ensure a good sheet shape. The rolling speed is usually in the range of from 100 to 3000 m/min, and the interpass time is usually in the range of from 0.01 to 100 sec.

After completion of the hot rolling, a hot-rolled sheet is usually cooled by air cooling and a subsequent water cooling and then coiled to form a 5- to 10-ton coil. The present invention features the coiling step.

The specified condition of the coiling after completion of the hot rolling, or the post-hot rolling coiling, according to the present invention will be described below.

The post-hot rolling coiling temperature must be lower than 700° C., because a product sheet having a good flux density, $B_8$, of 1.88T or higher is obtained in this coiling temperature range, as seen from FIG. 1. The lower limit of the coiling temperature is not specified. Coiling at room temperature (for example, 20° C.) or lower is not industrially preferred as it requires a special cooling system different from usual cooling system, such as water cooling and mist cooling, etc. The cooling after coiling is usually carried out by air cooling the 5- to 20-ton coil, and therefore, the cooling rate is slow at around 0.005° C./sec. This cooling is not specifically limited but is preferably effected at a higher cooling rate by water cooling, etc., to prevent an excessive coarsening of precipitates such as $Fe_3C$ when the coiling is carried out at a temperature of from about 500° to about 700° C.

The thus coiled and cooled sheet is subsequently cold-rolled, i.e., without annealing the hot-rolled sheet prior to cold rolling. The present invention also features the cold rolling step.

The specified condition of the cold rolling according to the present invention will be described below.

The cold rolling of the present invention is carried out by a plurality of rolling passes in which a steel sheet is held at a temperature of from 50° to 500° C. for 1 minute or longer, at least once at the stage between the rolling passes, because a product sheet having a good flux density $B_8$, of 1.88T or higher can be obtained when an interpass aging at 50° to 500° C. for 1 minute or longer is effected, as seen from FIGS. 2 and 3. The interpass aging is effective even when carried out only once, and further improves the magnetic characteristic if effected two or more times, i.e., in a manner such that the rolling pass and the aging are alternately repeated. The upper limit of the duration of the aging time is not specified but is preferably shorter than 5 hours, from the point of view of productivity. Accordingly, the aging temperature is preferably selected so that the aging is completed within 5 hours. A lower aging temperature requires a longer aging time. The aging may be effected by the heat generated by the work of cold rolling, but heating equipment or annealing equipment may be used when the temperature rise due to cold rolling is not sufficient for effecting the aging.

The cold rolling of the present invention is carried out at a reduction of 80% or higher to obtain, in the decarburization-annealed stage, an appropriate amount of grains having a sharp {110} <001>-orientation and grains having an orientation easily encroached on by the former grains, such as a {111} <112>-orientation, etc., and to enhance the magnetic characteristic.

A cold-rolled sheet is decarburization-annealed, applied with an annealing separator and then final-annealed, in a usual manner, to form a final product sheet. When the inhibitor strength in the decarburization-annealed stage is not sufficient to meet the strength required for secondary recrystallization, a treatment for strengthening the inhibitors becomes necessary in the final annealing step or the like. In a known method of strengthening the inhibitors, an atmosphere having a raised partial nitrogen pressure is used for the final annealing of an Al-containing steel sheet.

EXAMPLES

Example 1

First, 40 mm thick steel slabs comprising 0.056 wt % C, 3.28 wt % Si, 0.14 wt % Mn, 0.005 wt % S, 0.029 wt % acid-soluble Al, 0.0078 wt % N, and the balance Fe and unavoidable impurities, were heated at 1150° C., allowed to cool to 1050° C., and then hot-rolled by six rolling passes to form 2.3 mm thick hot-rolled sheets. The hot rolling was completed at 912° C. and the hot-rolled sheets were then subjected to a coiling simulation in which the sheets were air-cooled for 1 sec, subsequently cooled at a cooling rate of 100° C./sec to different temperatures (coiling temperatures) of 800° C. (1), 500° C. (2), and 350° C. (3), held at those coiling temperature for 1 hour, and then furnace-cooled at a cooling rate of about 0.01° C./sec.

The hot-rolled sheets were not annealed.

The not-annealed hot-rolled sheets were cold-rolled at a reduction of about 85%, to form 0.335 mm thick cold-rolled sheets. During the cold rolling, an interpass aging was effected for some sheets (referred to as case "a") and not effected for other sheets (referred to as case "b"). In the former case "a", the sheets were subjected to an interpass aging at 150° C. for 5 minutes (duration time after the necessary equalizing time had elapsed) in three stages between the passes of the cold rolling, when the sheets had thicknesses of 1.6, 1.2, and 0.6 mm.

The cold-rolled sheets were decarburization-annealed at 830° C. for 150 sec (duration time after the necessary equalizing time had elapsed), applied with an annealing separator containing MgO as the major component, and then final-annealed by a process in which the sheets were heated at a heating rate of 10° C./hr to 1200° C. in an atmosphere of 75% $N_2$ plus 25% $H_2$, and subsequently, held at 1200° C. for 20 hours in a changed atmosphere of 100% $H_2$.

The magnetic characteristic of the thus-obtained product sheets is shown in Table 1, together with the corresponding process conditions.

TABLE 1

| Post-hot rolling coiling condition | Interpass aging condition | $B_8$ (T) | Note |
|---|---|---|---|
| 1 | a | 1.84 | Comparison |
| 1 | b | 1.84 | Comparison |
| 2 | a | 1.88 | Present Invention |
| 2 | b | 1.85 | Comparison |
| 3 | a | 1.90 | Present Invention |
| 3 | b | 1.86 | Comparison |

Example 2

First, 26 mm thick steel slabs comprising 0 033 wt % C, 3.25 wt % Si, 0.14 wt % Mn, 0.006 wt % S, 0.027 wt % acid-soluble Al, 0.0078 wt % N, and the balance Fe and unavoidable impurities, were heated at 1150° C., allowed to cool to 1050° C., and then hot-rolled by six rolling passes to form 2.0 mm thick hot-rolled sheets. The hot rolling was completed at 921° C. and the hot-rolled sheets were then subjected to a coiling simulation in which the sheets were air-cooled for 1 sec, subsequently cooled at a cooling rate of 50° C./sec to different temperatures (coiling temperatures) of 750° C. (1) and 400° C. (2), held at those coiling temperatures for 1 hour, and then furnace-cooled at a cooling rate of about 0.01° C./sec.

The hot-rolled sheets were not annealed.

The not-annealed hot-rolled sheets were cold-rolled at a reduction of about 86%, to form 0.285 mm thick cold-rolled sheets. During the cold rolling, an interpass aging was effected for some sheets (referred to as cases "a" and "b") and not effected for other sheets (referred to as case "c"). In case "a", the sheets were aged at 200° C. for 5 minutes (duration time after the necessary equalizing time had elapsed) in three stages between the passes of the cold rolling when the sheets had thicknesses of 1.6, 1.2, and 0.6 mm, and in case "b", the sheets were aged at 200° C. for 10 minutes (duration time after the necessary equalizing time had elapsed), in one stage between passes, when the sheets had a thickness of 1.0 mm.

The cold-rolled sheets were decarburization-annealed at 830° C. for 120 sec, and subsequently, at 850° C. for 20 sec, applied with an annealing separator containing MgO as the major component, and then final-annealed by a process in which the sheets were heated at a heating rate of 10° C./hr to 880° C. in an atmosphere of 25% $N_2$ plus 75% $H_2$, then heated to 1200° C. at a heating rate of 10° C./hr in a changed atmosphere of 75% $N_2$ plus 25% $H_2$, and held at 1200° C. for 20 hours in a changed atmosphere of 100% $H_2$.

The magnetic characteristic of the thus-obtained product sheets is shown in Table 2, together with the corresponding process conditions.

TABLE 2

| Post-hot rolling coiling condition | Interpass aging condition | $B_8$ (T) | Note |
|---|---|---|---|
| 1 | a | 1.85 | Comparison |
| 1 | b | 1.85 | Comparison |
| 1 | c | 1.85 | Comparison |
| 2 | b | 1.91 | Present Invention |
| 2 | a | 1.90 | Present Invention |
| 2 | c | 1.86 | Comparison |

Example 3

First, 40 mm thick steel slabs comprising 0.079 wt % C, 3.25 wt % Si, 0.07 wt % Mn, 0.024 wt % S, 0.029 wt % acid-soluble Al, 0.0082 wt % N, 0.10 wt % Sn, 0.06 wt % Cu, and the balance Fe and unavoidable impurities, were heated at 1300° C., allowed to cool to 1050° C., and then hot-rolled by six rolling passes to form 2.3 mm thick hot-rolled sheets. The hot rolling was completed at 923° C., and the hot-rolled sheets were then subjected to a coiling simulation in which the sheets were air-cooled for 1 sec, subsequently cooled at a cooling rate of 100° C./sec to 450° C. (coiling temperature), held at that temperature for 1 hour, and then furnace-cooled at a cooling rate of about 0.01° C./sec.

The hot-rolled sheets were not annealed.

The not-annealed hot-rolled sheets were cold-rolled at a reduction of about 85%, to form 0.335 mm thick cold-rolled sheets. During the cold rolling, an interpass aging was effected for some sheets (referred to as case "a") and not effected for the other sheets (referred to as case "b"). In case "a", the sheets were subjected to an interpass aging at 250° C. for 5 minutes (duration time after the necessary equalizing time had elapsed), in four stages between the passes of the cold rolling, when the sheets had thicknesses of 1.7, 1.3, 0.7, and 0.5 mm.

The cold-rolled sheets were decarburization-annealed at 830° C. for 120 sec, and subsequently at 950° C. for 20 sec, applied with an annealing separator containing MgO as the major component, and then final-annealed under the same condition as in Example 2.

The magnetic characteristic of the thus-obtained product sheets is shown in Table 3, together with the corresponding process conditions.

TABLE 3

| Interpass aging condition | $B_8$ (T) | Note |
|---|---|---|
| a | 1.90 | Present Invention |
| b | 1.86 | Comparison |

Example 4

First, 26 mm thick steel slabs comprising 0.045 wt % C, 3.25 wt % Si, 0.065 wt % Mn, 0.024 wt % S, 0.08 wt % Cu, 0.018 wt % Sb, and the balance Fe and unavoidable impurities, were heated at 1300° C., allowed to cool to 1050° C., and then hot-rolled by six rolling passes to form 2.3 mm thick hot-rolled sheets. The hot rolling was completed at 898° C. and the hot-rolled sheets were then subjected to a coiling simulation in which the sheets were air-cooled for 1 sec, subsequently cooled at a cooling rate of 70° C./sec to 400° C. (coiling temperature), held at that temperature for 1 hour, and then furnace-cooled at a cooling rate of about 0.01° C./sec.

The hot-rolled sheets were not annealed.

The not-annealed hot-rolled sheets were cold-rolled at a reduction of about 85%, to form 0.335 mm thick cold-rolled sheets. During the cold rolling, an interpass aging was effected for some sheets (referred to as cases "a" and "b") and not effected for other sheets (referred to as case "c"). In case "a", the sheets were aged at 200° C. for 5 minutes (duration time after the necessary equalizing time had elapsed) in three stages between the passes of the cold rolling, when the sheets had thicknesses of 1.6, 1.3, and 0.7 mm, and in case "b", the sheets were aged at 400° C. for 5 minutes (duration time after the necessary equalizing time had elapsed) in three stages between passes, when the sheets had thicknesses of 1.5, 1.0, and 0.7 mm.

The cold-rolled sheets were decarburization-annealed at 830° C. for 120 sec, and subsequently at 910° C. for 20 sec, applied with an annealing separator containing MgO as the major component, and then final-annealed under the same condition as in Example 2.

The magnetic characteristic of the thus obtained product sheets is shown in Table 4, together with the corresponding process conditions.

TABLE 4

| Interpass aging condition | $B_8$ (T) | Note |
|---|---|---|
| a | 1.91 | Present Invention |
| b | 1.90 | Present Invention |
| c | 1.84 | Comparison |

The present invention makes a major contribution to the industry in that it enables the production of a grain-oriented electrical steel sheet having a superior magnetic characteristic through a single step of cold rolling and without an annealing of the hot-rolled sheet, by controlling the temperature of the coiling after hot rolling and by carrying out an interpass aging between the cold rolling passes.

What is claimed is:

1. A process for producing a grain-oriented electrical steel sheet having a superior magnetic characteristic, comprising the steps of:

hot-rolling a silicon steel slab comprising 0.021 to 0.100 wt % C, 2.5 to 4.5 wt % Si, one or more elements for forming inhibitors, and the balance consisting of Fe and unavoidable impurities, to form a hot-rolled sheet;

coiling the hot-rolled sheet at a coiling temperature lower than 700° C.;

subsequently cold-rolling the hot-rolled sheet at a reduction of 80% or more, effected by a plurality of rolling passes, to a final product sheet thickness;

holding the steel sheet at a temperature of from 50° to 500° C. for 1 minute or longer at least once at the stage between the rolling passes of said cold rolling;

decarburization-annealing the cold-rolled sheet; and final-annealing the decarburization-annealed sheet.

2. A process according to claim 1, wherein said steel slab contains at least one inhibitor-forming element selected from the group consisting of Al, N, Mn, S, Se, Sb, B, Cu, Bi, Nb, Cr, Sn, and Ti.

3. A process according to claim 1, wherein the hot-rolled sheet is coiled to form a 5- to 20-ton coil.

4. A process according to claim 3, wherein said coil is air-cooled.

5. A process according to claim 1, wherein said coiling of the hot-rolled sheet is carried out at a coiling temperature higher than 500° C. and lower than 700° C. and the thus-formed coil is water-cooled.

6. A process according to claim 1, wherein said holding of the steel sheet at a temperature of from 50° to 500° C. at the stage between the cold rolling passes is carried out for 5 hours or shorter.

7. A process according to claim 1, wherein said holding of the steel sheet at a temperature of from 50° to 500° C. at the stage between the cold rolling passes is effected by utilizing the heat generated by the cold rolling.

* * * * *